United States Patent [19]

Hollenton et al.

[11] 4,196,738

[45] Apr. 8, 1980

[54] METHOD AND APPARATUS FOR VARIEGATING RECONSTITUTED TOBACCO SHEET

[75] Inventors: Frank Hollenton, Richmond, Va.; Herbert J. Light, Norwalk, Conn.

[73] Assignee: AMF Incorporated, White Plains, N.Y.

[21] Appl. No.: 861,749

[22] Filed: Dec. 19, 1977

[51] Int. Cl.[2] ..... A24B 3/00; A24B 3/14

[52] U.S. Cl. ..... 131/15 C; 131/17 A; 131/140 C

[58] Field of Search ..... 131/15 C, 17 A, 20 A, 131/140 C

[56] References Cited

U.S. PATENT DOCUMENTS

| | | | |
|---|---|---|---|
| 3,477,440 | 11/1969 | Licis | 131/17 A X |
| 4,047,536 | 9/1977 | Asfour | 131/140 C |
| 4,109,665 | 8/1978 | Godfrey, Jr. et al. | 131/15 C |

FOREIGN PATENT DOCUMENTS

| | | | |
|---|---|---|---|
| 2515433 | 11/1975 | Fed. Rep. of Germany | 131/17 A |

*Primary Examiner*—Lee S. Cohen

*Attorney, Agent, or Firm*—George W. Price; Charles J. Worth

[57] ABSTRACT

A method and apparatus for imparting a permanent variegated pattern to a reconstituted tobacco sheet by selectively densifying areas of the sheet in the presence of heat.

17 Claims, 8 Drawing Figures

METHOD AND APPARATUS FOR VARIEGATING RECONSTITUTED TOBACCO SHEET

The invention relates generally to reconstituted tobacco sheet and more particularly to the method and apparatus for variegating or patterning such sheets.

In addition to other characteristics and qualities, the appearance of the wrapper of a cigar is very important to a cigar smoker's aesthetic senses. However, the inherent appearance of reconstituted tobacco sheet is dull and flat. Although use of reconstituted tobacco sheet in place of natural leaf would greatly facilitate cigar manufacture with automatic machinery, its lack luster appearance has been one of the major reasons why reconstituted tobacco sheet has not been more universally accepted for use as cigar wrappers.

Up to this time there have been many attempts to give reconstituted tobacco sheet a natural leaf look, which have had very disappointing results. It has been found that wrapper made of reconstituted tobacco sheet with a printed vein pattern when applied to cigars gave a very false appearance considered to be more objectionable than plain or unadulterated reconstituted tobacco sheet. On the other hand, in many instances embossing was found to be destructive to reconstituted tobacco sheet or the embossing effect was pulled out when wrappers of embossed sheet were wrapped on cigars. Fading and excessive brittleness were also encountered as a result of prior attempts to variegate or pattern reconstituted tobacco sheet. Therefore none of the earlier attempts to variegate or impart a vein-like pattern to reconstituted tobacco sheet was sufficiently successful to provide a commercially useful product.

A tobacco leaf after curing and when ready for use in a smoking product is not completely of the same color. In addition to color or shading differences of the veins, the lamina may, in many instances, be mottled or have shaded areas. Therefore, a pattern to be imparted to reconstituted tobacco sheet must include such a mottling or variegation in addition to vein simulation if the pattern is to appear to be realistic. It has been found that reconstituted tobacco sheet can be darkened by densification, the degree of darkening being generally proportional to the amount of densification. Subjecting reconstituted tobacco sheet to an elevated temperature assists in densifying the sheet and provides a permanent shading or pattern.

Accordingly, an object of this invention is to provide the foregoing method and apparatus to variegate or pattern reconstituted tobacco sheet to simulate natural tobacco leaf for use as cigar wrappers.

Another object of the present invention is to provide the foregoing method and apparatus which has no deleterious effects on the sheet being variegated or patterned.

Still another object of the present invention is to provide the foregoing method and apparatus capable of imparting a permanent variegation or pattern to reconstituted tobacco sheet which has a natural leaf appearance when applied as wrappers to cigars.

The foregoing and other objects and advantages of the invention will appear more fully hereinafter from a consideration of the detailed description which follows, taken together with the accompanying drawings wherein several embodiments of the invention are illustrated by way of example. It is to be expressly understood however, that the drawings are for illustration purposes only and are not to be construed as defining the limits of the invention.

Figure 1:
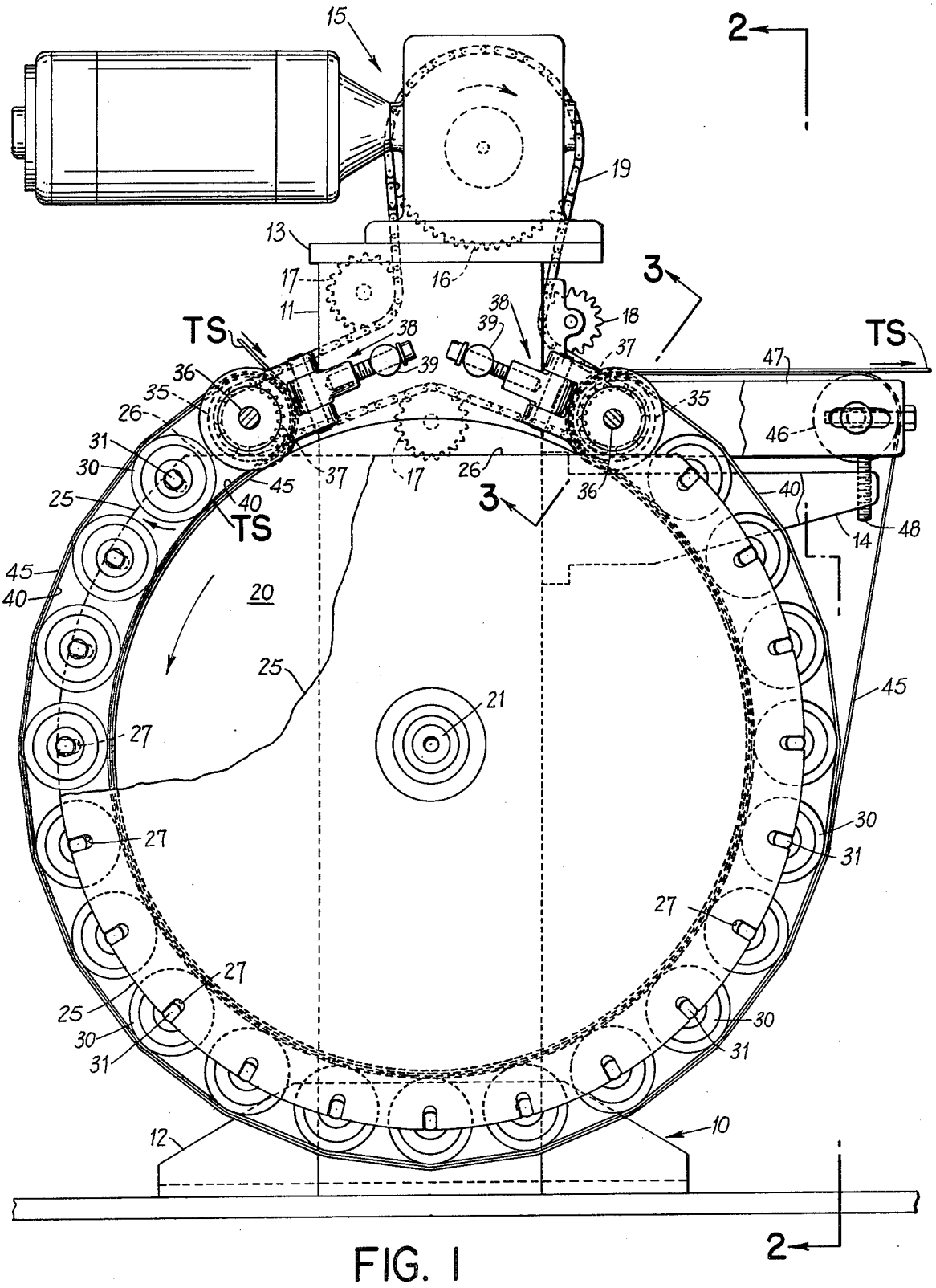
FIG. 1 is a side elevational view of apparatus made in accordance with the present invention.
Figure 2:
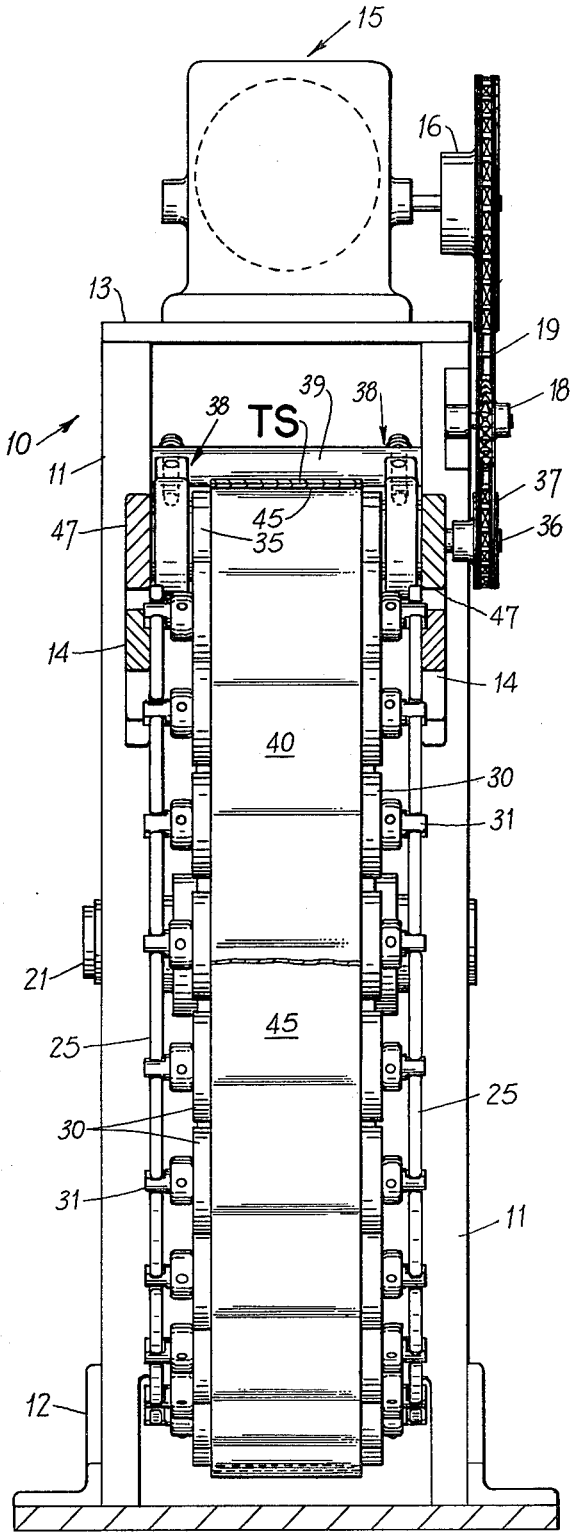
FIG. 2 is a rear elevational view with a portion of the apparatus broken away taken on line 2—2 of FIG. 1.

Referring now to the drawings and particularly to FIGS. 1 and 2, apparatus made in accordance with the present invention is provided with mounting means or a frame 10 having a pair of spaced parallel vertical members or legs 11 connected together at the bottom of the frame by a base 12 and at the top by a plate 13 on which is mounted drive means such as a motor and gear box assembly 15 having an output or drive pulley or sprocket 16. A pair of circular plates 25 are fixed or connected to the inner or opposed surfaces of the legs 11.

The plates 25, disposed coaxially with one another, are each provided with a flat 26 at its top and an equally spaced series of slots 27 extending radially inwardly from its circular periphery. The slots 27 of each of the plates 25 are axially aligned with the corresponding slots 27 of the other of the plates 25. An imparter drum 20 is rotatably mounted between and concentric with the circular plates 25 on a shaft 21 which extends through both circular plates and the legs 11 of frame 10 to which they are attached.

The circular surface or face of the drum 20 is provided with a relief pattern in much the same manner as an embossing roll; the pattern being that of a tobacco leaf or a selected portion thereof, and being repetative if required, depending upon the size of the drum. To effectively impart the pattern with a desired degree of permanency to the reconstituted tobacco sheet, heat within the range of approximately 175° F. to 200° F. is required. This is accomplished by heating the face of drum 20 in any suitable manner well known in the art such as by providing inlet and outlet ports in the opposite ends of the shaft 21 (only one being shown) for a controlled flow of heating medium into and out of the drum.

A plurality of idler or pressure rollers 30 are provided around the drum 20, each having shaft means 31 extending from both ends of the roller into one of the axially aligned pairs of peripheral slots 27 of the circular plates 25. Although a series of nineteen spaced idler or pressure rollers 30 are shown, this is for illustration purposes only and is not intended to define the limits of the invention. At both the infeed and output ends of the series of rollers 30 are provided hoop tension rollers 35 (see also FIG. 3) each having shaft means 36 extending from both ends which are connected, by a pair of threaded position adjusting or take-up means 38 and fixed brackets 39 therefor connected to the legs 11 of frame 10. A sprocket or pulley 37 is mounted on one end of each shaft means 36 for rotation in unison the roller 35 thereof, as will be discussed.

All of the rollers 30 and 35 are encircled by an endless tension belt 40 made of any suitable high strength resilient material and having a width substantially equal to the end-to-end width of the rollers and the face of the drum 20. The hoop tension of the belt 40 is varied by the adjusting means 38 which move the tension rollers 35 toward or away from the adjacent pressure rollers 30. It should be noted that such a tension adjustment can be accomplished by repositioning either or both of the tension rollers 35.

A substantially horizontal fixed bracket 14 is connected to the legs 11 of frame 10 and extends rearwardly therefrom to a free end provided with a set screw or threaded member 48 which when rotated moves vertically. A take-up bracket 47 is pivotally mounted at one end to the shaft means 36 of the tension roller 35 at the output end of the series of rollers 30. The bracket 47 extends rearwardly from its mounted end, overlying the fixed bracket 14, to a free end which is engaged by the upper end of the screw 48 and mounts a spring loaded rotatable tension/take-up roller 46.

An endless imparter/spacer belt 45 made of any suitable hard structured stretch proof material, such as a 95 A Shore durometer polyurethane, encircles the tension belt 40 and the tension/take-up roller 46. The inner or working runs of the belts 40 and 45 are in face-to-face contact with each other and disposed between the face of the drum 20 and the rollers 30 and 35; the belt 40 being adjacent the rollers and the belt 45 being adjacent the drum. The inner run of belt 40 exerts a radial pressure against the inner run of belt 45 toward the face of the drum 20 while the outer run of belt 40 exerts a radial force against rollers 30 toward the drum 20 which is intermittently transmitted or transmitted for short spaced intervals of time by the overlying inner runs of the belts where the rollers 30 contact belt 40. The portion of the belt 45 between the output tension roller 35 and the tension/take-up roller 46 forms a substantially horizontal feed-out for the reconstituted tobacco sheet TS.

The motor/gear box assembly 15 drives the output sprocket or pulleys 37 by an endless chain or belt 19 retained by idler sprockets or pulleys 17 and a take-up sprocket or pulley 18 to rotatably drive the tension rollers 35. The driven rollers 35 through belt 40 causes the rollers 30 to rotate in unison and drive the imparter/spacer belt 45 which, in turn, by direct contact with or through a reconstituted tobacco sheet TS rotatably drives the imparter drum 20.

In operation, a reconstituted tobacco sheet TS is fed past the infeed tension roller 35 into the interface between the moving inner run of the imparter belt 45 and the heated face of the rotating imparter drum 20 which carry the sheet past each of the pressure rollers 30 to the horizontal run of the belt 45 past the tension/take-up roller 46. The pressure exerted by the inner run of belt 40 on the imparter belt 45 maintains the reconstituted tobacco sheet TS firmly upon the heated face of the drum 20.

The imparter belt 45 being of a stretch proof material and moving at the same speed as the face of the imparter drum 20 eliminates any possibility of deterioration of the reconstituted tobacco sheet TS because of differential movement between the sheet and face of the imparter drum 20 or the imparter belt 45. It has been found that when the imparter belt 45 is made of a resilient material, the reconstituted tobacco sheet is displaced into the drum face in a manner similar to male/female die embossing. As previously discussed, this type of embossing or patterning is not permanent and is pulled out when the reconstituted tobacco sheet is wrapped on a cigar. When a non-resilient material such as a flexible metal belt is used, either insufficient pressure must be used which provides unsatisfactory patterning or with sufficient pressure the drum face tends to cut the reconstituted tobacco sheet. It has been found that an imparter belt 45 made of a non-stretching material in the range of approximately 87 to 100 A Shore durometer hardness will, with appropriate pressure, eliminate cutting by the drum face and with the drum face will provide sufficient compression to cause the desired selective densification and impart a permanent pattern to the reconstituted tobacco sheet TS.

Figure 3:
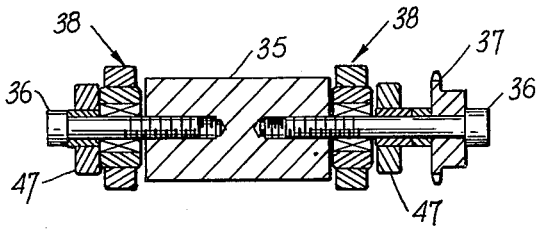
FIG. 3 is a sectional view of a drive roller taken on line 3—3 of FIG. 1.

In FIGS. 1 to 3, the motor/gear box assembly 15 is provided with an endless chain or belt 19 to drive the novel apparatus by driving the tension rollers 35. As an alternative as shown in FIGS. 4 and 5, the output sprocket or pulley 16 is replaced by a smaller sprocket or pulley **16*a*, which is drivingly connected by the endless chain or belt 19 to a sprocket or pulley 22 fixed on the shaft 21 to rotatably drive the drum 20**.

Figure 7:
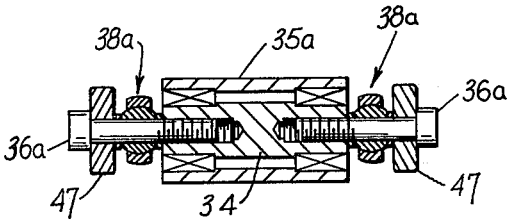

As best shown in FIG. 3, the shaft means 36 of the driven tension rollers 35 are mounted in suitable bearings in the position adjusting means 38. However, when the drum 20 is driven the rotatable shaft means is not required to rotate. Accordingly, as best shown in FIG. 7, modified tension rollers **35*a* are provided with bearings mounted on a core member 34 of a modified shaft means 36*a*. In place of the adjusting means 38, modified threaded tension adjusting or take-up means 38*a* with alignment means are mounted on the shaft means 36*a* on both sides of the rollers 35*a* as are the arms of the bracket or carrier 47 for the tension/take-up roller 46**.

Figure 6:
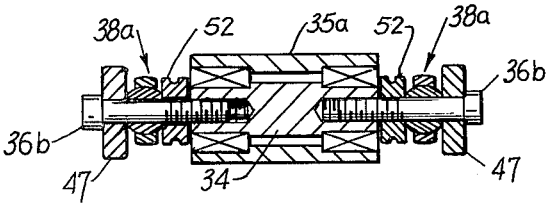
FIG. 6 is a sectional view of an end roller taken on line 6—6 of FIG. 4.
Figure 4:
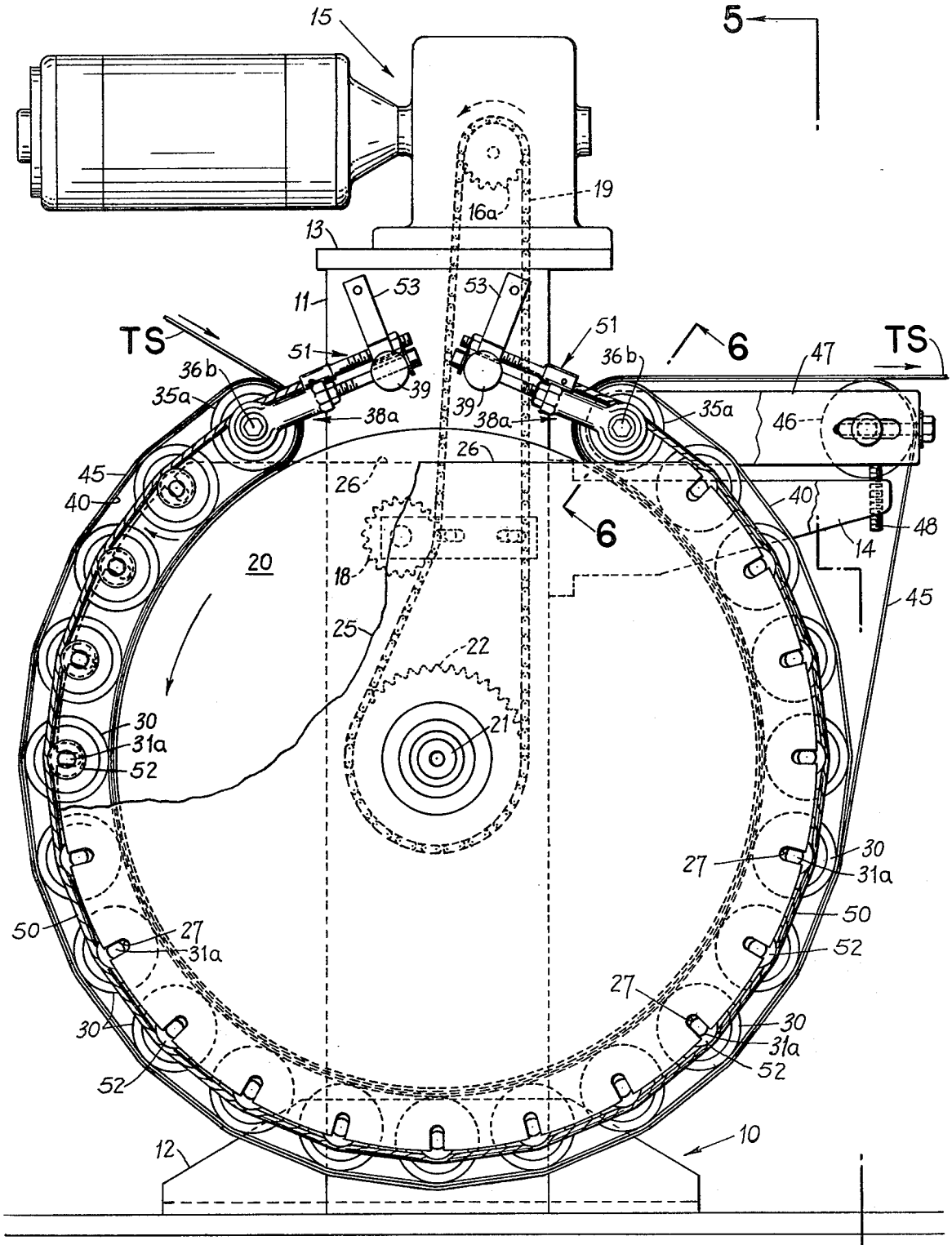
FIGS. 4 and 5 are views corresponding to FIGS. 1 and 2 of a modified form of the apparatus.
Figure 5:
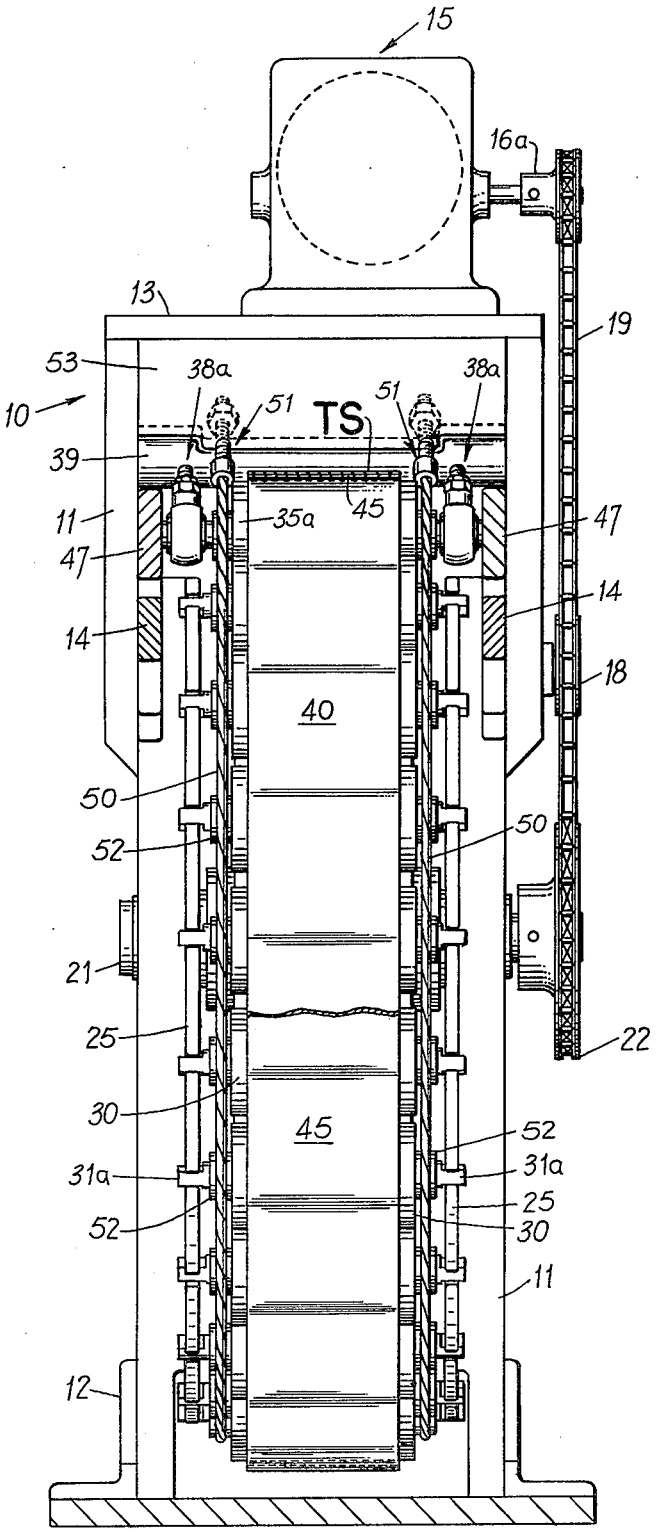

As is also shown in FIGS. 4 and 5, the novel apparatus may be further modified by providing means for independently adjusting the imparting pressure of the rollers 30 without disturbing the holding pressure exerted by the inner run of the belt 40 on the imparter belt 45. This is accomplished by a pair of loops 50 of wire rope or cable, each provided at opposite ends of the rollers 30. The rollers 30 are each provided with a modified shaft means **31*a*, which mounts a sheave 52 at each end of the roller for the wire rope loops 50. Each loop is provided with threaded adjusting means 51 at its ends which are connected by fixed brackets 53 to the legs 11 of the frame 10. The tension rollers 35*a*, as shown in FIG. 6, are provided with further modified shaft means 36*b*, which mount sheaves 52 in addition to threaded tension adjusting means 38*a* and the arms of the bracket or carrier 47 for the tension/take-up roller 46**.

Figure 8:
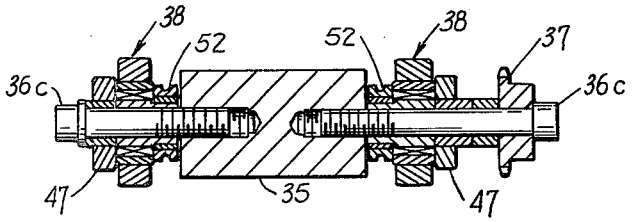
FIGS. 7 and 8 are sectional views illustrating modifications of the rollers of FIGS. 3 and 6.

Accordingly, the novel apparatus can be driven by a motor/gear box assembly 15 driving the drum 20 with and without the wire cable tensioning means 50, and also by driving the tensioning rollers 35 in the absence of the wire cable tensioning means. However, the motor/gear box assembly 15 also can be used to drive the tension rollers 35 as shown in FIG. 1 when the novel apparatus is provided with the wire cable tensioning means 50, as shown in FIGS. 4 and 5. In this instance, the rollers 30 are provided with modified shaft means **31*a* mounting sheaves 52, and the threaded belt tension adjusting means 38, the arms of the carrier 47 and the sprocket 37 as is shown in FIG. 8**.

It should be understood that for proper tracking of the belts 40 and 45 and for imparting a pattern of an intensity along one edge which is equal to the intensity along the other edge of the reconstituted tobacco sheet, the hoop tension along the opposite edges of belt 40 must be equal and the tension of the two wire cable loops 50, if used, must be equal.

When imparting a pattern or variegation to a reconstituted tobacco sheet for use as a cigar wrapper with a permanent natural looking vein-like appearance, the differentiation between the light and dark areas of the sheet must fall within limited parameters to provide a commercially acceptable product. It is not enough to measure the color of the sheet since reconstituted tobacco sheet can be made in a range of colors. It is noted that when using the foregoing novel method and novel apparatus, the portions of the sheet with no compacting or impacting pressure is of a lighter color and of a lower density while the areas of maximum compacting or impacting pressures is of a darker color and of a higher density. Therefore it is the color differences or differences in density which determines the natural vein-like or variegated color appearance.

To determine sheet density SD in grams/CC, the sheet thickness ST is measured in mils (thousandths of an inch with a Starrett Dial Indicator Gage, model 1010E or the equivalent. The sheet weight SW is measured in grams/ft$^2$ on a bone dry basis after suitable drying. Sheet density is then calculated as follows:

$$SD(\text{grams}/CC) = \frac{SW(\text{grams}/\text{ft}^2) \times 0.424 \frac{(\text{mils ft}^2)}{CC}}{ST(\text{mils})}$$

By subtracting the sheet density of the lighter areas from that of the darker areas, a density difference is obtained. It has been found that if the density difference is within the range of 0.05 to 0.20 grams/CC, the patterned reconstituted tobacco sheet is commercially acceptable for cigar wrapper.

Alternatively, such a determination can be made by determining color difference ΔE. To determine sheet color in darker and lighter areas a Gardiner Color Difference Meter is used which breaks the overall color down into three different components. The Rd component is the dark to light axis. The a component is the green to red axis. The b component is the yellow to blue axis. The composite of Rd, a and b axis readings is a three-way fix on the color of a material as an exact point in space. Color differences between two materials are best defined by ΔE values where:

$$\Delta E = \sqrt{(Rd_2 - Rd_1)^2 + (a_2 - a_1)^2 + (b_2 - b_1)^2}$$

It has been found that patterned reconstituted tobacco sheet with a ΔE color difference within the range of 1.0 to 3.0 is commercially acceptable for cigar wrapper.

Although several embodiments of the invention have been illustrated and described in detail, it is to be expressly understood that the invention is not limited thereto. Various changes may also be made in the design and arrangement of the parts without departing from the spirit and scope of the invention as the same will now be understood by those skilled in the art.

What is claimed is:

1. A method of imparting a permanent variegated leaf-like pattern to a reconstituted tobacco sheet comprising the steps of providing a constant pressure holding the sheet against the face of a drum and causing the sheet to move in unison with the drum face while intermittently transmitting additional pressure for short spaced intervals of time in the presence of heat thereby selectively densifying areas of said sheet for darkening such areas an amount depending upon the amount of densification.

2. A method in accordance with claim 1, and the temperature of such heat being in the approximate range of 175° F. to 200° F.

3. A method in accordance with claim 2, and the difference between the densities of the lightest and darkest of such areas of the sheet being in the approximate range of 0.05 to 0.20 grams/CC.

4. A method of imparting a permanent variegated leaf-like pattern to a reconstituted tobacco sheet comprising the steps of providing a rotating imparter drum having a heated circular face with a pattern in relief to be imparted to said sheet;

holding said sheet by pressure on said drum causing said face and sheet to move in unison; and at short spaced intervals applying additional pressure further urging said sheet against said face with sufficient force to selectively densify areas of said sheet in accordance with the pattern in relief.

5. A method in accordance with claim 4, wherein said drum face is heated to a temperature in the range of approximately 175° F. to 200° F.

6. A method in accordance with claim 5, and comprising the further step of providing an endless belt of non-stretching material with a hardness in the range of approximately 87 to 100 A Shore durometer for applying such pressures in the direction of said drum.

7. Apparatus for imparting a permanent variegated leaf-like pattern to a reconstituted tobacco sheet, comprising a rotatable imparter drum having a circular face with a pattern in relief to be imparted to the reconstituted tobacco sheet and motor means for rotating said drum;

means for heating said circular face to a predetermined temperature; and means disposed around a portion of said drum for providing a constant pressure holding said sheet on said circular face and causing said sheet to move in unison with said circular face, and providing a further pressure intermittently for short spaced intervals urging said sheet against said circular face causing selective densification by said pattern in relief.

8. The apparatus in accordance with claim 7, and said heating means heating said circular face to a temperature in the approximate range of 175° F. to 200° F.

9. The apparatus in accordance with claim 8, and said means providing pressures to said sheet comprising an arcuate series of spaced rollers;

a resilient endless belt under tension encircling said rollers, having an arcuate inner run the hoop tension of which provides the constant pressure and an arcuate outer run the hoop tension of which urges said rollers toward said drum thereby providing the further pressure; and a non-resilient endless belt having an inner run in face-to-face contact with the inner run of said resilient belt transmitting the constant and further pressures to said reconstituted tobacco sheet.

10. The apparatus in accordance with claim 9, and the end rollers of said series of rollers each being movable toward and away from the adjacent roller to adjust the hoop tension of said resilient endless belt;

and adjustment means for moving said end rollers.

11. The apparatus in accordance with claim 10, and said non-resilient endless belt having a hardness in the approximate range of 87 to 100 A Shore durometer.

12. The apparatus in accordance with claim 11, further comprising means drivingly connecting said motor means to said imparter drum.

13. The apparatus in accordance with claim 11, further comprising means drivingly connecting said motor means to said end rollers.

14. The apparatus in accordance with claim 11, and each of said rollers having shaft means including a pair of sheaves each at one end of the roller opposite from the other, a pair of loop means each engaging all of said sheaves at the same corresponding ends of said rollers; and means for adjusting the length each of said loop means thereby varying the further pressure while constant pressure remains unchanged.

15. The apparatus in accordance with claim 14, further comprising means drivingly connecting said motor means to said imparter drum.

16. The apparatus in accordance with claim 14, further comprising means drivingly connecting said motor means to said end rollers.

17. A reconstituted tobacco sheet having selectively darkened areas forming a permanent variegated leaf-like pattern for use as a cigar wrapper, the difference in the densities of the lightest and darkest areas of said sheet being in the approximate range of 0.05 to 0.20 grams/CC.

* * * * *